United States Patent [19]

Mailliet et al.

[11] Patent Number: 4,893,794

[45] Date of Patent: Jan. 16, 1990

[54] DEVICE FOR MOUNTING A GRIPPER TO A PIERCING MACHINE

[75] Inventors: Pierre Mailliet, Howald; Jean Metz, Luxembourg, both of Luxembourg

[73] Assignee: Paul Wurth S.A., Luxembourg

[21] Appl. No.: 250,688

[22] Filed: Sep. 22, 1988

[30] Foreign Application Priority Data

Oct. 6, 1987 [LU] Luxembourg ..... 87010

[51] Int. Cl.[4] ..... C21B 7/12

[52] U.S. Cl. ..... 266/271; 266/45

[58] Field of Search ..... 266/271, 272, 45

[56] References Cited

U.S. PATENT DOCUMENTS 4,602,770 7/1986 Mailliet et al. ..... 266/271

FOREIGN PATENT DOCUMENTS 0025423 3/1981 European Pat. Off. ..... 266/271

*Primary Examiner*—Scott Kastler

*Attorney, Agent, or Firm*—Fishman, Dionne & Cantor

[57] ABSTRACT

A device which allows for the easy mounting of a gripper for coupling a piercing rod to a working tool mounted on a sliding carriage of a piercing machine, and in which the gripper has a female thread designed to be screwed onto a threaded end piece of the working tool is presented. The device essentially comprises a supporting cage which is fixed to the carriage and which ensures the vertical and lateral support of the gripper and allows it to slide longitudinally.

5 Claims, 5 Drawing Sheets

DEVICE FOR MOUNTING A GRIPPER TO A PIERCING MACHINE

BACKGROUND OF THE INVENTION

The present invention relates to a device for mounting a gripper to a working tool mounted on a sliding carriage of a piercing machine. The gripper is of the type which couples a rod for piercing the taphole of a shaft furnace. The gripper has a female thread designed to be screwed onto a threaded end piece of a working tool.

A gripper of the type described above is disclosed in French patent document No. FR-8301046. The gripper is particularly intended for machines which carry out a process in which the closing and opening of the taphole involve an operation of installing and an operation of extracting a piercing rod. The piercing rod is discarded in the mass of the taphole between each successive casting.

These grippers function satisfactorily and are well suited for their intended purposes. However, since these grippers have been put into operation, numerous breaks have been found in the region of the threaded end piece of the working tool. There are many reasons for these breaks. One reason is that the gripper is subjected to many stresses, starting with the stresses arising as a result of the normal use of the gripper, especially under the action of the striker. The impacting of the striker tends to loosen the gripper from the working tool, and an excessive play in the thread accelerates the wear and destruction of the striker. Furthermore, the end piece of the working tool is constantly subjected to the bending moments arising as a result of the dead weight of the gripper which can be on the order of 50 kilograms.

In most cases, the breakage and wear of the thread are caused by stresses which arise from abnormal use which are superimposed on the existing stresses described above. For example, because of the dead weight of the gripper, it is very difficult to properly screw the gripper onto the threaded end piece of the working tool. This operation, which is carried out manually, involves alignment of the gripper with the threaded end piece and rotating the threaded end piece until it is engaged with the corresponding female thread of the gripper. At this moment, a pneumatic motor is usually activated to cause the end piece to rotate to ensure that the gripper is automatically clamped onto the end piece. If the gripper and the end piece are not properly threaded when the pneumatic motor is engaged, the threads will strip.

Another problem that often arises is the retraction of the machine from its working position when the tip of the piercing rod is not completely released from the mass of the taphole. The purpose of this retraction step is to save the machine from splashes of molten metal which occur as soon as the taphole is opened. In this instance, the piercing rod is exposed to very large bending moments which considerably increase the risk of breakage of the threaded endpiece of the working tool.

SUMMARY OF THE INVENTION

The above discussed problems and other disadvantages of the prior art are overcome or alleviated by the gripper-mounting device of the present invention. The device of the present invention eliminates most of the causes of wear and breakage of the fastening junction between the gripper and the working tool.

In a preferred embodiment, the gripper-mounting device of the present invention is comprised of a supporting cage fixed to a carriage which ensures the vertical and lateral support of the gripper and allows it to slide longitudinally. The gripper is supported in the support cage by means of four slide tracks which are preferably replaceable, so that the play between the gripper and the support cage can be modified.

The above-discussed and other features and advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figures 1, 2:
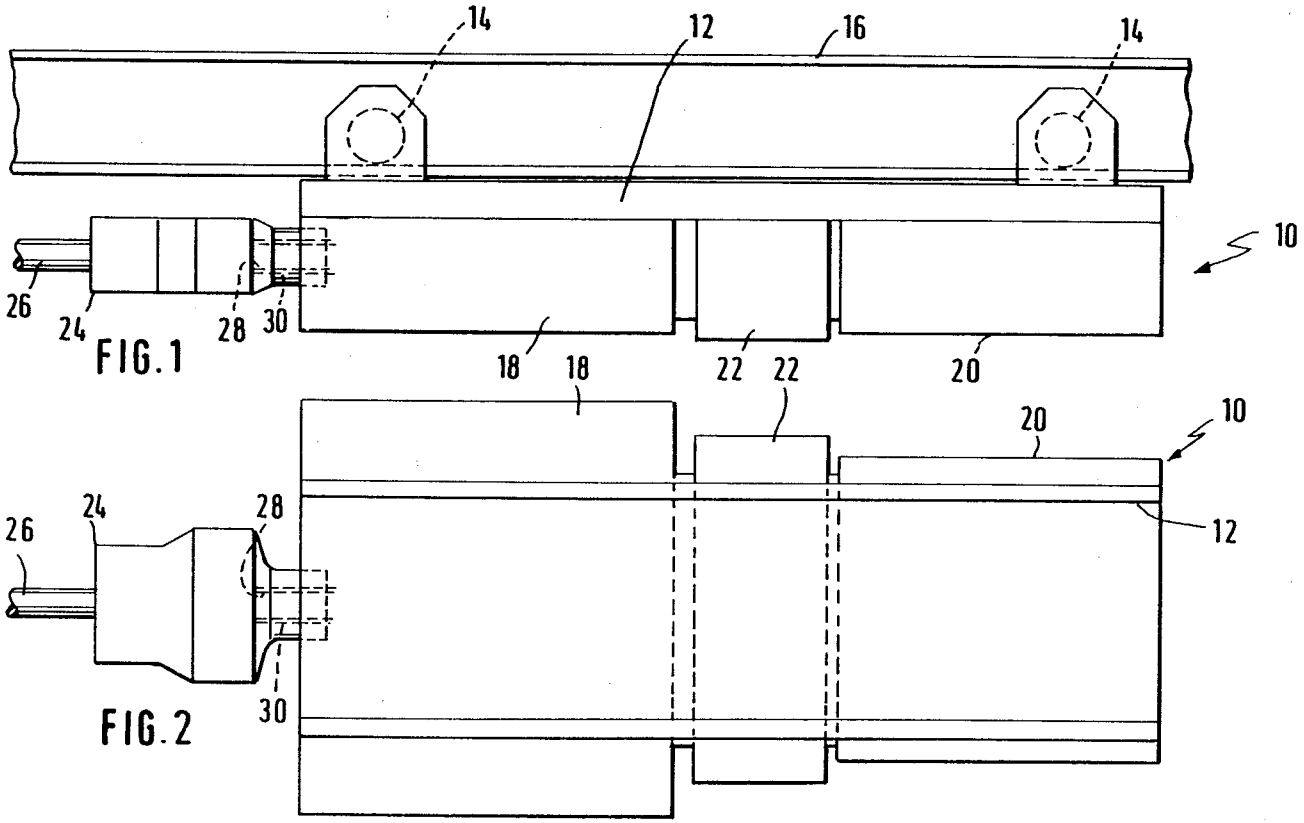
FIG. 1 is a side elevation view of a prior art method of fastening a gripper to a working tool.
FIG. 2 is a top elevation view of the prior art method of FIG. 1.

Referring jointly to FIGS. 1 and 2, in accordance with the prior art, a working tool 10 is fastened to a moveable carriage 12 which can slide by means of rollers 14, along a mount 16 of a machine for piercing a taphole of a shaft furnace. In the prior art embodiment of FIGS. 1 and 2, working tool 10 consists of a rear-impact striker 18 and of a rear-impact striker 20, between which a rotator 22 is located.

A gripper 24 is used for securing a piercing rod 26 and for transmitting to piercing rod 26 the movements and percussion blows generated by working tool 10. Gripper 24 has, on the rear side thereof, a threaded axial bore 28, by means of which it is screwed onto a threaded endpiece 30 forming part of working tool 10.

Figure 3:
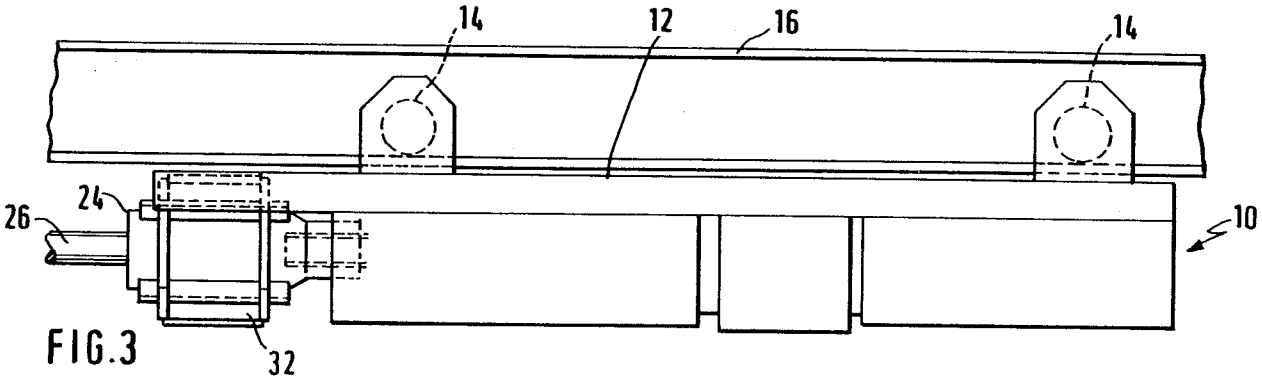
FIG. 3 is a side elevation view of the device of the present invention in which a gripper is supported by a support cage and attached to a working tool.
Figure 4:
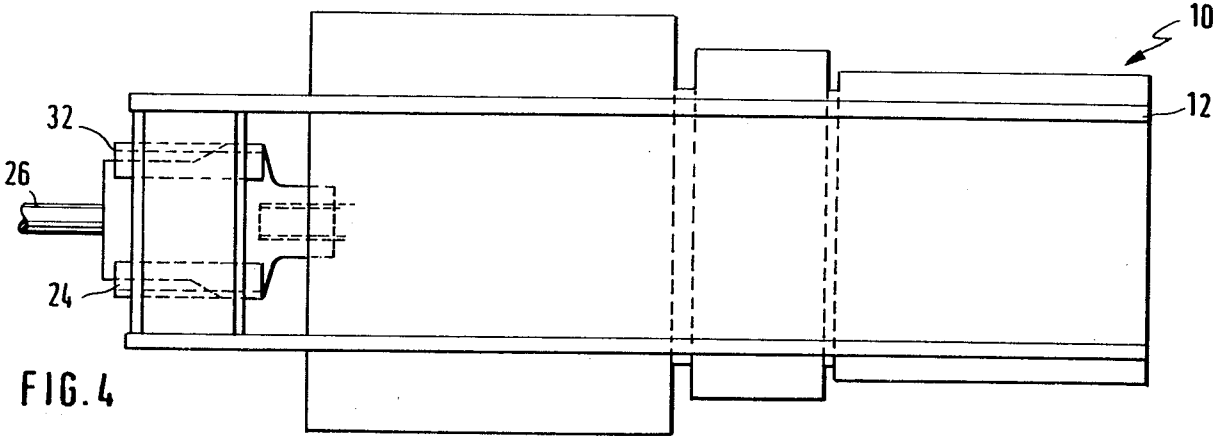
FIG. 4 is a top elevation view of the device of FIG. 3.

A review of FIGS. 3 and 4 show the same machine as that of FIGS. 1 and 2, to which the reference numerals of these FIGURES have been assigned in order to designate the corresponding elements. However, in contrast to the prior art embodiment shown in FIGS. 1 and 2, in the embodiment of FIGS. 3 and 4, gripper 24 is supported by a support cage 32 in accordance with the present invention. Support cage 32 is an important feature of the present invention and will be explained in more detail with reference to FIGS. 6 and 7. Cage 32 ensures axial guidance and vertical support and is fixed to carriage 12.

Figure 5:
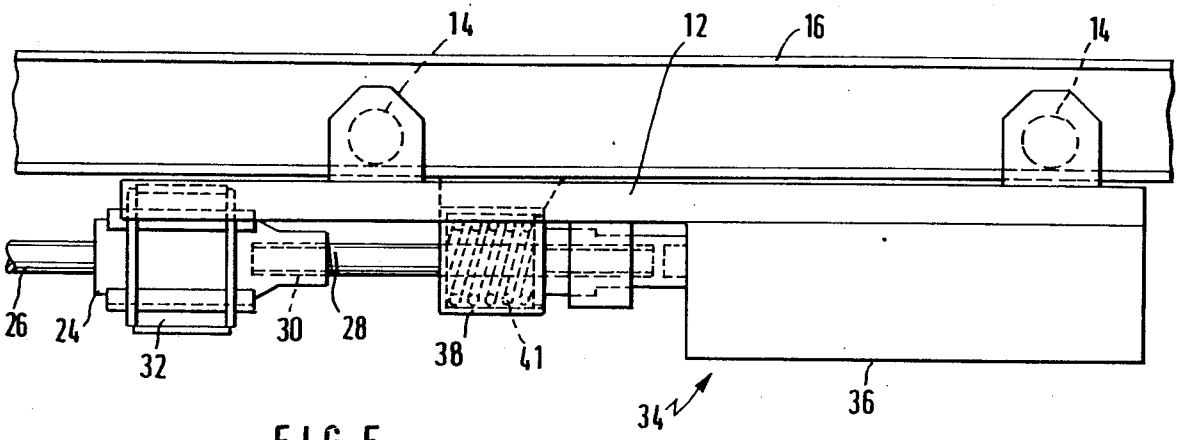
FIG. 5 is a side elevation view of the support cage of FIG. 3 in conjunction with an alternate embodiment of a working tool.

FIG. 5 shows a view similar to that of FIG. 3 including cage 32 for supporting and guiding automatic gripper 24. The difference between the embodiments of FIGS. 3 and 5 is simply that a different working tool is used. In fact, in the embodiment of FIG. 5, working tool 34 consists of a front-impact striker 36 combined with a rotator. Associated with striker 36 is an impact reverser 38 which essentially comprises a powerful helical spring 41 for reversing the direction of the percussions generated by tool 34.

Figure 6:
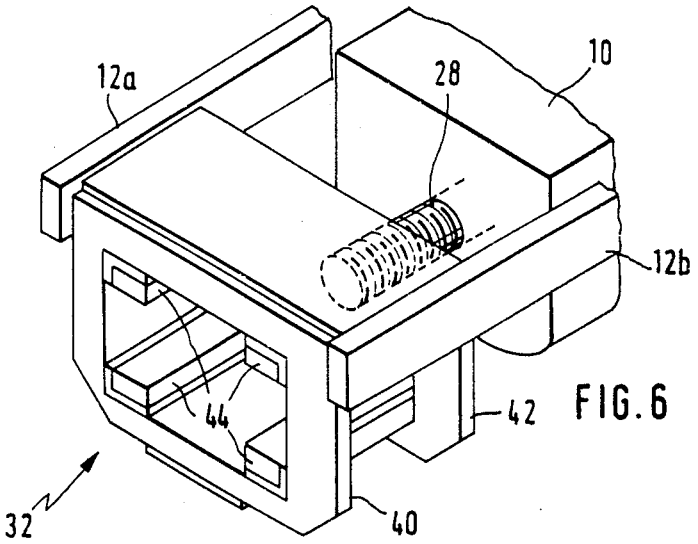
FIG. 6 is a front perspective view of the support cage and part of a working tool of the device of FIG. 3.
Figure 7:
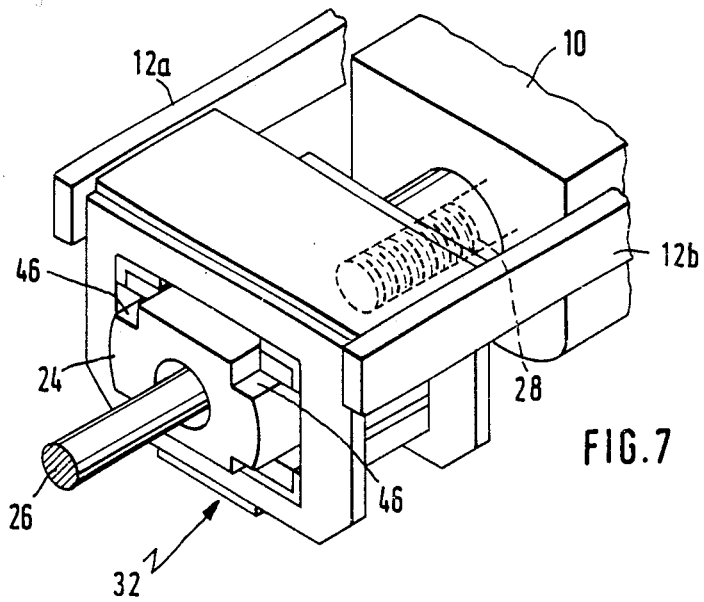
FIG. 7 is a front perspective view of a gripper coupled to a working tool using the device of FIG. 3.

FIGS. 6 and 7 show the details of cage 32. Cage 32 is fastened rigidly between two bars 12*a* and 12*b* forming part of carriage 12. Cage 32 comprises two vertical frames 40 and 42 which can house gripper 24 with some peripheral play in order to allow gripper 24 to slide into cage 32 without difficulty. Removable and replaceable slide tracks 44 are provided on the four inner corners of frames 40 and 42 so as to make sliding of gripper 24 easier and improve its guidance and retention. Tracks 44 interact with corresponding longitudinal grooves 46 on gripper 24.

The installation of gripper 24 involves simply engaging it into cage 32, until the thread of end piece 28 is engaged with the female thread of gripper 24. From that moment, rotator 22 can be actuated in order to rotate end piece 28 slowly and thus cause gripper 24 to retract automatically into cage 32.

It will be appreciated that because of the structure and positioning of cage 32, there is always self-alignment of gripper 24 on end piece 28. As a result, the threads of ends piece 28 are not stressed during the mounting or dismouting of gripper 24.

Furthermore, all the external forces other than the blows of striker 36, in particular the stresses caused by the weight of gripper 24 and those caused by clumsy handling, are transmitted to carriage 12 by means of cage 32. In other words, the threaded end piece 28 of working tool 10 is no longer subjected to bending stress.

Moreover, because gripper 24 cannot rotate in its cage 32, during operation of the piercing machine, self-clamping by the gripper can be carried out by placing rotator 22 under pressure in the direction of end piece 28 in thread 30 of gripper 24, so that the risks of loosening under the action of the striker are reduced.

Figure 8:
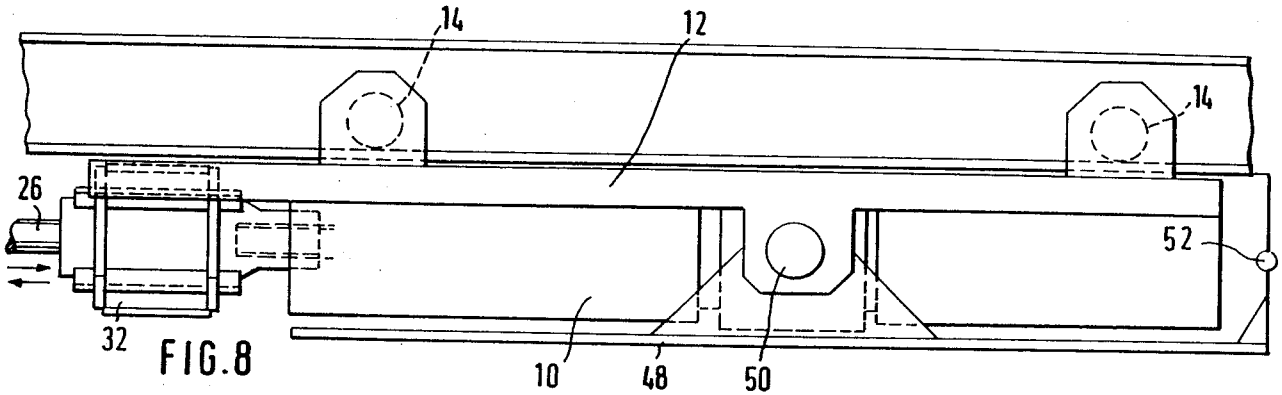
FIG. 8 is a side perspective view of an alternate embodiment of the device of FIG. 3.
Figure 9:
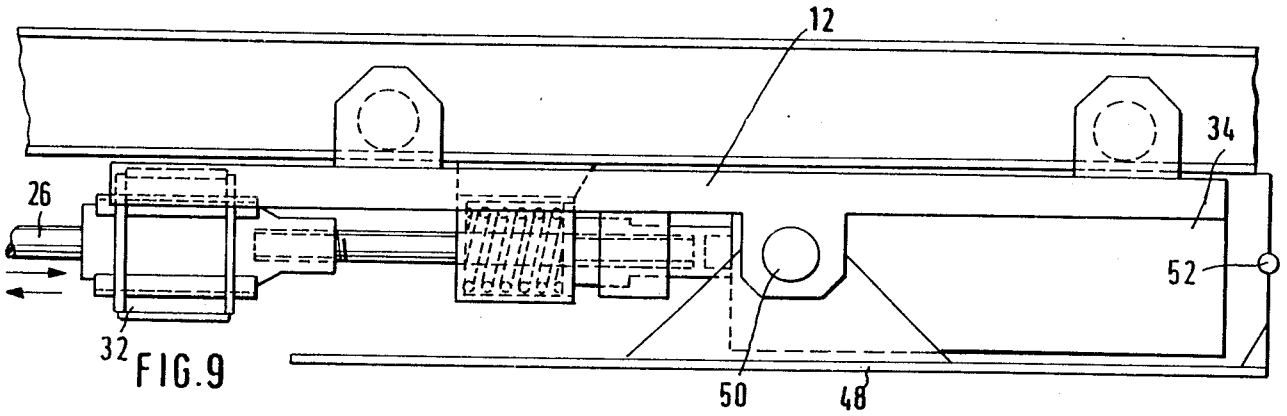
FIG. 9 is a side perspective view of an alternate embodiment of the device of FIG. 3.

FIGS. 8 and 9 respectively depict alternative embodiments of FIGS. 3 and 5, which are intended for reducing the risks of deformation of end piece 28 as a result of incorrect alignment (attributable to the machining) of cage 32. In these embodiments, working tools 10 and 34 are not directly mounted on carriage 12, but instead are mounted on plate 48 which is suspended under joint 49. Joint 49 can consist of a simple horizontal pivot pin 50 with some lateral play on either side of pin 50. A tilting about pin 50 thus makes it possible to compensate for an error or vertical alignment, while lateral sliding allowed by the above mentioned play compensates for an error or horizontal alignment.

Joint 49 between plate 48 and carriage 12 can, of course, also consist of a cardanic suspension.

The alignment is adjusted by means of a well known adjustment system represented diagrammatically by reference 52; which also makes it possible to limit the degrees of freedom and prevent a complete tilting of plate 48.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Device for mounting a gripper to a working tool, the working tool being mounted on a sliding carriage of a piercing machine, the gripper being adapted for coupling a rod to the working tool for piercing the taphole of a shaft furnace, the gripper having a female thread for threading onto a threaded endpiece of the working tool, including:

support cage means fixed to the sliding carriage, said supporting cage means including means for maintaining vertical and lateral support of the gripper and means for allowing the gripper to slide longitudinally relative to the support cage.

2. Device according to claim 1 including:

slide track means in said cage means for supporting the gripper.

3. Device according to claim 2 wherein:

said slide track means comprises four spaced tracks.

4. Device according to claim 2 wherein:

said slide track means are removeable.

5. Device according to claim 1 including:

plate means suspended under the sliding carriage by means of a joint, the working tool being mounted on said plate means.

* * * * *